United States Patent [19]

Peitz

[11] Patent Number: 4,612,608

[45] Date of Patent: Sep. 16, 1986

[54] DIMMED VEHICLE HEADLIGHT

[75] Inventor: Wolfgang Peitz, Erwitte, Fed. Rep. of Germany

[73] Assignee: Westfälische Metall Industrie KG Hueck & Co., Lippstadt, Fed. Rep. of Germany

[21] Appl. No.: 670,324

[22] Filed: Nov. 9, 1984

[30] Foreign Application Priority Data

Nov. 9, 1983 [DE] Fed. Rep. of Germany ..... 3340462

[51] Int. Cl.[4] ..... F21U 7/00

[52] U.S. Cl. ..... 362/297; 362/304; 362/346; 362/341

[58] Field of Search ..... 362/297, 302, 346, 298, 362/347, 350, 304, 341

[56] References Cited

U.S. PATENT DOCUMENTS

| | | | |
|---|---|---|---|
| 3,176,124 | 3/1965 | Cibie | 362/297 |
| 3,688,149 | 8/1972 | Pitkjaan | 362/346 |
| 4,351,018 | 9/1982 | Fratty | 362/304 |

FOREIGN PATENT DOCUMENTS

| | | | |
|---|---|---|---|
| 255192 | 7/1926 | United Kingdom | 362/297 |
| 285891 | 7/1928 | United Kingdom | 362/297 |
| 962129 | 6/1964 | United Kingdom | 362/297 |
| 972296 | 10/1964 | United Kingdom | 362/297 |
| 1100778 | 1/1968 | United Kingdom | 362/297 |
| 1248445 | 10/1971 | United Kingdom | 362/297 |
| 1253055 | 11/1971 | United Kingdom | 362/297 |
| 1347126 | 2/1974 | United Kingdom | 362/297 |
| 1391731 | 4/1975 | United Kingdom | 362/297 |
| 1556010 | 11/1979 | United Kingdom | 362/297 |
| 2093579 | 9/1982 | United Kingdom | 362/297 |

*Primary Examiner*—Ronald B. Cox
*Attorney, Agent, or Firm*—Horst M. Kasper

[57] ABSTRACT

The invention provides a headlight for a motor vehicle with a concave reflector, which has a light filament disposed in its inner part with the longitudinal axis of the filament about in parallel with the direction of the outgoing beam. The reflector is composed of a surface spanned by nearly parabolic branches generated by the intersection of the reflector and of planes including the axis of the reflector. The upper part of the reflector includes parabola branches having a focal point close to the vertex point and a focal point more remote from the vertex. At least the lower part of the reflector has the focal points of the conical sections near parabolic branches form a focal line, where the length of the focal line coincides at least in part about with the position and length of the incandescent filament. The section through the transition between upper and lower reflector part is represented by a cone section, which is nearly parabolic.

21 Claims, 9 Drawing Figures

DIMMED VEHICLE HEADLIGHT

BACKGROUND OF THE INVENTION

1. Field of the Invention

The invention relates to a dimmed headlight for vehicles which has as a light source, a longitudinal filament extending in the direction of the optical axis and disposed in a concave reflector.

2. Brief Description of the Background of the Invention Including Prior Art

A headlight for a vehicle with such a reflector is taught in German Patent DE-PS No. 2,205,610. However, in this reference the course of the reflection surface is formed such that the reflector results in a middle horizontal section of a parabola, where the focal point coincides with the focal point of the upper parabola branch close to the vertex. The light provided by such a reflector shows a high spread and scattering in the horizontal direction, which is not desirable for all applications of a dimmed headlight. In addition, this reflector exhibits a sharp edge directed toward the rear side at the transition from the upper to the lower part. The edge is either provided as a very sharp edge or has to be covered. In case the reflector is produced from sheet metal, this transition cannot be produced with a sufficiently sharp edge. In addition, it has been shown that this reflector illuminates only insufficiently the regions disposed immediately ahead of the motor vehicle.

SUMMARY OF THE INVENTION

1. Purposes of the Invention

It is an object of the invention to provide a reflector such that the individual reflection surfaces not only run continuously into each other but that in addition, the two reflection surfaces shown in the prior art are modified to provide a steady running transition.

It is a further object of the invention to provide a reflector where the images of the incandescent filament are focussed substantially near the axial direction of the reflector.

It is a further object of the present invention to provide a reflector where the intersection lines of a plane including the optical axis of the reflector and the reflector are nearly parabolic sections with branches having focal points near an incandescent light source disposed along the axis of the reflector.

These and other objects and advantages of the present invention will become evident from the description which follows.

2. Brief Description of the Invention

The present invention provides a dimmed vehicle headlight comprising a light source extending in the direction of a light beam to be emitted and a concave reflector surrounding the light source where planar sections through the reflector surface approximate sections of cones which have the same vertex point disposed in the opposite direction of the beam direction relative to the light source such that the vertex point forms the center of a Cartesian coordinate system. The spacing of the close point of the light source relative to the vertex point is designated as $f_1$ and the distance of the remote point of the light source relative to the vertex is designated as $f_2$. A y-axis is disposed at the connection line from the vertex to the light source and the cone section shaped surfaces are in a coordinate system where an x-axis runs through the vertex point in a plane containing the respective cone section. The cone sections approximate the following equation $$y^2(A)=2p(A)x+kp(A)x^2$$

where A is the absolute value of the intersection angle of the respective cone section plane with a horizontal plane, p(A) is between about $0.95f_1$ and $1.05f_1$ for cone sections disposed in a horizontal plane containing the vertex point. p(A) is between from about $2f_1-f_2$ to $f_1$ for the cone section disposed in a vertical plane above said horizontal plane and p(A) is a continuous decreasing function of the angle A for cone sections disposed above said horizontal plane. p(A) is about equal $f_2$ for the cone section disposed below said horizontal plane and disposed in a vertical plane, with the proviso that at least for an intersection angle of cone section plane and horizontal plane of about 31 degrees the value p(A) starts to be different from p(O). k can have a value from about—0.02 to 0.02. Preferably the absolute value of k is less than about 0.005, and the absolute value of k may be about zero.

The function p(A) can be an about linear function of the angle A: $p(A)=f_1+A/90(f_2-f_1)$ for cone sections disposed below said horizontal plane containing the vertex of the cone sections.

The function p(A) cn be an about sinusoidal function of the angle A: $p(A)=f_1+\sin(A)(f_2-f_1)$ for cone sections disposed below said horizontal plane containing the vertex of the cone sections.

The function p(A) can be an about square function of the angle A: $p(A)=f_1+(A^2/8100)(f_2-f_1)$ for cone sections disposed below said horizontal plane containing the vertex of the cone sections.

The function p(A) can be an about linear function of the angle A: $p(A)=f_1+uA/90(f_1-f_2)$ for cone sections disposed above said horizontal plane containing the vertex of the cone sections and where the parameter u is a parameter having a value of from about 0 to 1.

The function p(A) can be: $p(A)=f_1+u(f_1-f_2)$ for the cone section disposed above said horizontal plane containing the vertex of the cone sections and disposed in the vertical plane and where the parameter u can have a value of from about 0 to 0.5.

The function p(A) can assume the value: p(90 degrees upward)$=f_1$ for the cone section disposed above said horizontal plane containing the vertex of the cone sections and disposed in the vertical plane and where the parameter u can have a value of from about 0 to 1.

p(A) may be about $f_1$ for cone sections disposed in a horizontal plane containing the vertex point.

The present invention provides a dimmed vehicle headlight where the upper part of the reflector extends by at most 30 degrees downward beyond the horizontal middle plane on the side of the reflector disposed to the side of the oncoming traffic.

The present invention further provides a dimmed vehicle headlight comprising a concave reflector having an optical axis and an electric filament extending longitudinally in the direction of the optical axis. A horizontal section of the reflector is represented by a parabola, the focal point of which coincides with the focal point of the upper reflector part. A part of the reflector disposed below its horizontal plane is a parabola branch and is provided with a focal point more remote from the vertex point, and all center sections in the lower reflector part containing the optical axis are branches of a respective parabola, where the focal length of the parabola branches continuously decreases from a vertical section to the horizontal section. A part of the reflector disposed above its horizontal plane is a parabola branch and is provided with a focal point close to a vertex point. The focal points of the parabola branches are disposed on the optical axis, and the loci of the focal points include the extension of the filament.

The transition from the upper reflector section formed as part of a rotation parabola to the lower reflector part associated with a line of focal points can be disposed in an axis intersecting plane located below the horizontal middle plane on the side of the reflector disposed relatively close to the center of the road, and the angle between the axis intersecting plane and the middle plane can be about 15 degrees.

The focal point of the upper reflector section can be represented by a focal line, which starts at the focal point of the parabola associated with the horizontal middle section of the reflector and which extends toward the vertex of the reflector.

The present invention further provides a method for producing a dimmed beam at a vehicle headlight comprising forming a concave reflector having an internal reflection surface where planar sections through the reflector surface approximate sections of cones which have the same vertex point disposed in the opposite direction of the beam direction relative to the light source such that the vertex point forms the center of a Cartesian coordinate system. The spacing of the close point of the light source relative to the vertex point is designated as $f_1$ and the distance of the remote point of the light source relative to the vertex is designated as $f_2$. A y-axis is disposed at the connection line from the vertex to the light source. The cone section shaped surfaces are in a coordinate system where an x-axis runs through the vertex point in a plane containing the respective cone section, and the cone sections approximate the following equation:

$$y^2(A)=2p(A)x+kp(A)x^2$$

where A is the absolute value of the intersection angle of the respective cone section plane with a horizontal plane. p(A) is between about $0.95f_1$ and $1.05f_1$ for cone sections disposed in a horizontal plane containing the vertex point. p(A) is between from about $2f_1-f_2$ to $f_1$ for the cone section disposed above said horizontal plane and disposed in a vertical plane. p(A) is a continuous decreasing function of the angle A for cone sections disposed above said horizontal plane. p(A) is about equal $f_2$ for the cone section disposed below said horizontal plane and disposed in a vertical plane, with the proviso that at least for an intersection angle of cone section plane and horizontal plane of about 31 degrees the value p(A) starts to be different from p(O). k can have a value from about—0.02 to 0.02. Preferably, the absolute value of k in this method for producing a dimmed vehicle headlight can be less than about 0.005, and the absolute value of k can be about zero.

The method for a dimmed vehicle headlight according to the present invention also includes placing a light source in the reflector with the longitudinal extension of the light source at least in part coinciding with a line of focal points of cone section branches formed by intersecting the reflector surface with respective planes each including the axis of the reflector.

In the present method for producing a dimmed beam at a vehicle headlight, the function p(A) can be an about linear function of the angle A:

$p(A)=f_1+A/90(f_2-f_1)$ for cone sections disposed below said horizontal plane containing the vertex of the cone sections. The function p(A) can be an about linear function of the angle A:

$p(A)=f_1+uA/90(f_1-f_2)$ for cone sections disposed above said horizontal plane containing the vertex of the cone sections where the parameter u is a parameter having a value of from about 0 to 1. The function p(A) can be:

$p(A)=f_1+u(f_1-f_2)$ for the cone section disposed above said horizontal plane containing the vertex of the cone sections and disposed in the vertical plane and where the parameter u can have a value of from about 0 to 0.5. The function p(A) can assume the value: p(90 degrees upward)$=f_1$ for the cone section disposed above said horizontal plane containing the vertex of the cone sections and disposed in the vertical plane, where the parameter u can have a value of from about 0 to 1.

Thus in accordance with the invention, the horizontal section through the reflector is a parabola with the focal point coinciding with the focal point of the upper reflector part and where all intersections including the axis of the reflector result in the lower reflector part, in nearly parabolic branches which exhibit a continuously decreasing focal length starting with the vertical section and going to the horizontal section.

If it is desired to generate an asymmetric dimming light with the invention reflector, where the bright-/dark delineation runs increasingly on the side disposed remote from the oncoming traffic, then the transition from the upper reflector section formed as part of a rotation parabola to the lower reflector section exhibiting a focal line on the side of the reflector directed towards the center of the road is disposed at an axis intersecting plane running below the horizontal middle plane, which axis intersecting plane has an angle of about 15 degrees with the horizontal middle plane. In fact, here a step is generated between the upper and the lower part of the reflector. This step results, however, only on the side of the reflector which affects the illumination of the right edge of the road. In addition, the step is of only a small height and the butt face is directed downward such that it is in the shadow. Inaccuracies during the production of this step thus do not result in light glare for the oncoming traffic.

According to a preferred embodiment of the invention the reflector is constructed such that the focal point of the upper reflector section is a focal line which starts from the focal point of the parabola resulting in the horizontal middle section of the reflector and extends toward the vertex point of the relflector. In the case of such a shape of the reflector, the light from the upper reflector part is increasingly pulled apart in the vertical direction such that the illumination of the field directly ahead, that is, the areas immediately in front of the vehicle are illuminated at an increased rate. The headlight with such a reflector is particularly suited for a working headlight which is placed very high above the surface to be illuminated and where the surface is to illuminated uniformly.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
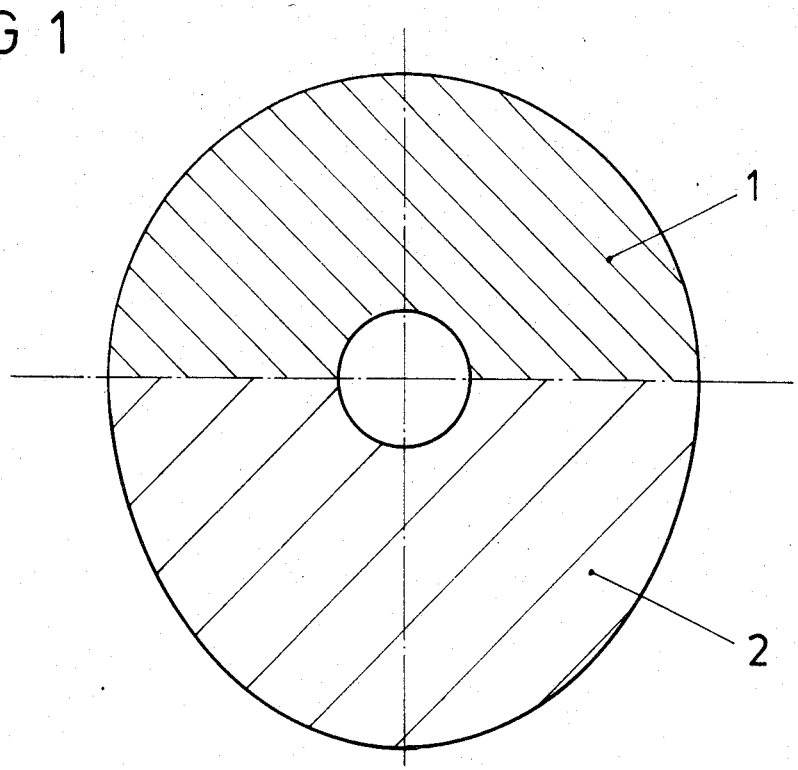
FIG. 1 is a schematic, elevational view of the reflector.

In accordance with the present invention there is provided a dimmed vehicle headlight with a longitudinal incandescent filament extending in the direction of the optical axis of a reflector and serving as a light source. The filament is placed in a concave reflector where the part of the reflector disposed above the horizontal plane running through its optical axis exhibits a focal point close to the vertex and where the lower part of the reflector exhibits a focal point remote from the vertex such that these focal points, which belong to in each case an upper and lower vertical branch of a parabola of a vertical center section along the optical axis, include the incandescent filament between them. The upper and the lower part of the reflector is formed as a continuous steady surface with a vertex. The horizontal section is a parabola $P_3$, $P_6$, the focal point $f_3$, $f_6$ of which coincides with the focal point of the upper reflector part, and all center sections along the optical axis 5 in the lower reflector part 2, 10 result in branches of parabolas $P_2$, $P_5$, which exhibit a continuously decreasing focal length when going from the vertical section to the horizontal section.

The transition from the upper reflector section 1 formed as part of a rotation parabola to the lower reflector section 2 having a focal line on the side directed toward the center of the road of the reflector is disposed in an axis intersecting plane 7 running below the horizontal middle plane 6 and these planes include between them an angle $\alpha$ of about 15 degrees.

The focal point of the upper reflector section 9 can be a focal line $F_4$, $F_6$ which starts at the focal point $F_6$ of the parabola $P_6$ resulting from the horizontal middle section of the reflector and running toward the vertex point S of the reflector.

Figure 2:
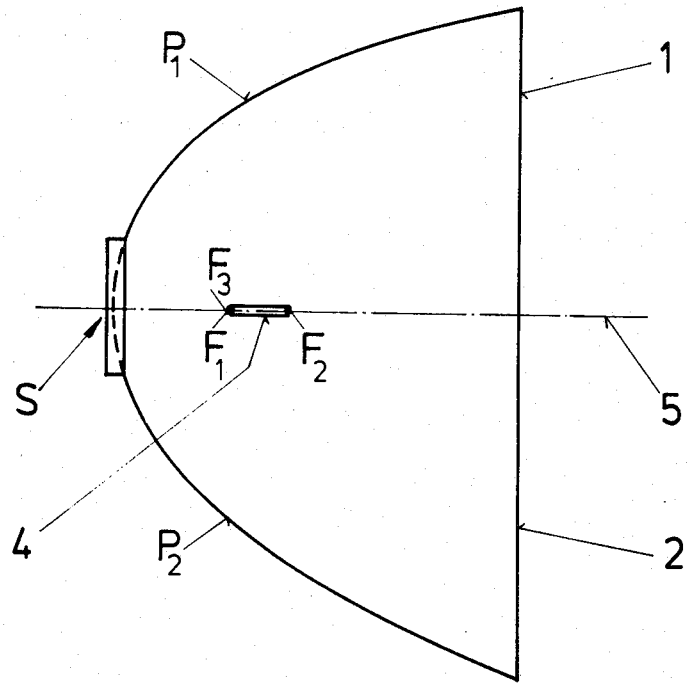
FIG. 2 is a vertical sectional view of the reflector.
Figure 3:
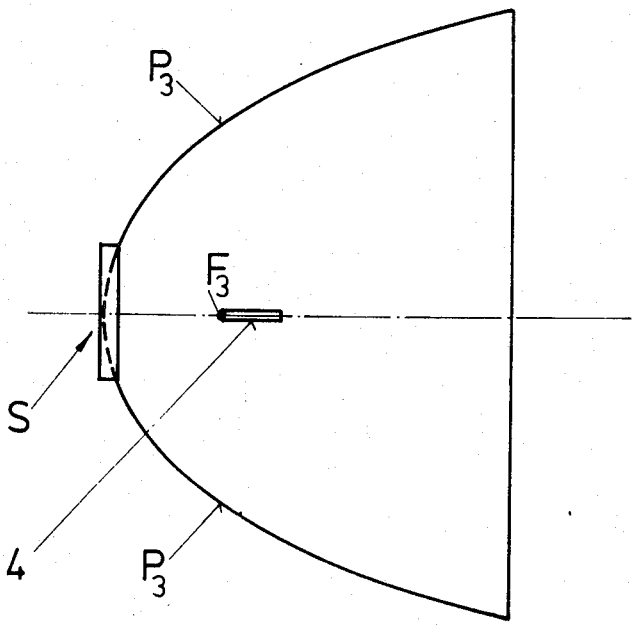
FIG. 3 is a planar sectional view of the reflector for a light with an asymmetrically running light/dark boundary.

The reflector illustrated in FIGS. 1 to 3 exhibits a upper part 1, which shows in a vertical middle section the parabola branch $P_1$ with the focal point at $F_1$. This reflector part 1 is a section of a rotation parabola. The lower part 2 of the reflector exhibits in the vertical middle section the parabola branch $P_2$ with the corresponding focal point $F_2$. The two parabola branches have a joint focal point S. The distance between the focal points $F_1$ and $F_2$ corresponds to the length of the incandescent light filament 4. The reflector shows in the horizontal middle section, the form of a parabola $P_3$ with a focal point $F_3$, which coincides with the focal point $F_1$. Since the parabola exhibits the same focal point S as the parabola branches $P_1$ and $P_2$, the focal length of $P_3$ is equal to the focal length of $P_1$. The reflection surfaces of upper reflector part 1 and the lower reflector part 2 therefore merge continuously into each other. No beams exit from the reflector which run in an upward direction relative to the optical axis 5. The images of the incandescent light filament generated by the upper part of the reflector form a semicircular light figure, where the longitucial axes of the images of the incandescent light source pass like beams through the center point of the semicircular light figure. The position of the images of the incandescent lamp generated by the lower reflector part is illustrated in FIG. 8.

Figure 4:
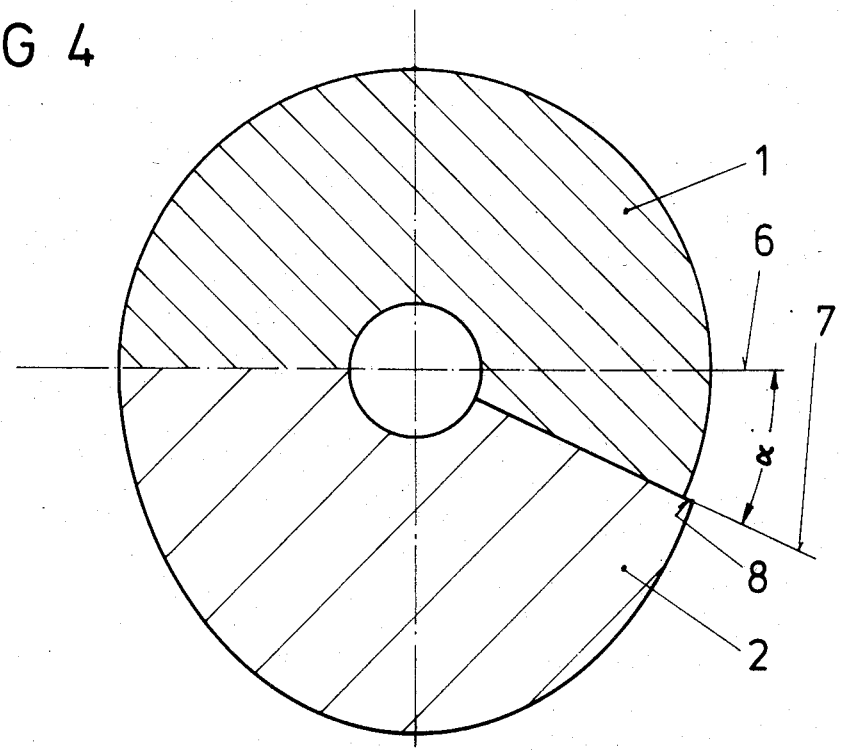
FIG. 4 is an elevational view of a reflector for a light with an asymmetric light/dark boundary.

The upper part of the reflector shown in FIG. 4 extends beyond the horizontal middle plane 6 and in fact up to a center plane 7, which forms an angle $\alpha$ of about 15 degrees relative to the horizontal center plane 6. The light/dark boundary generated by this reflector is asymmetrical and has an increasing branch on the side remote from the oncoming traffic. This reflector is provided with a step in the plane 7, the butt face 8 of which, however, is directed downward and thus is in the shadow relative to the light source 4.

Figure 5:
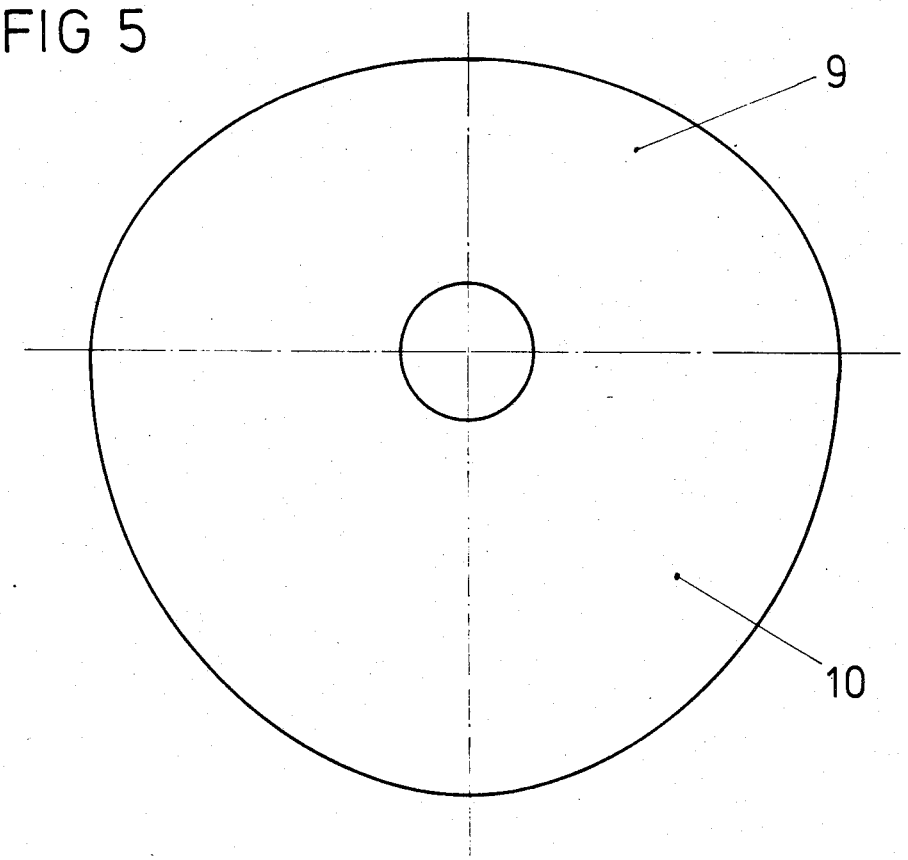
FIG. 5 is a schematic elevational view of another embodiment of a reflector.
Figure 7:
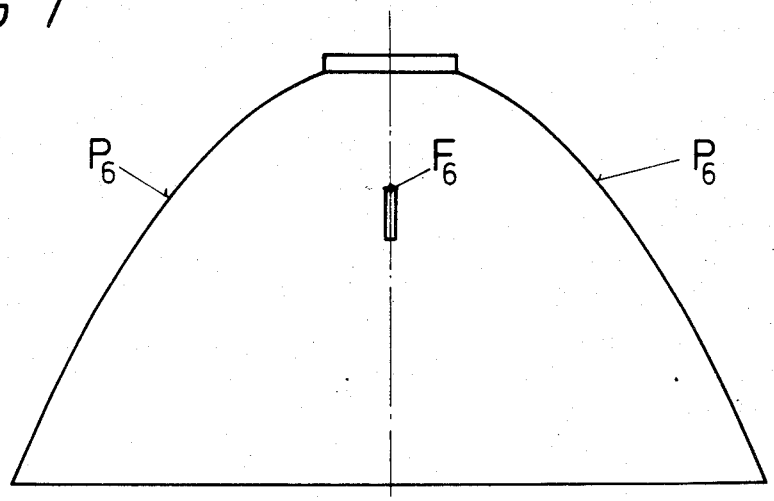
FIG. 7 is a schematic view of a horizontal center section of the reflector of FIG. 5.
Figure 6:
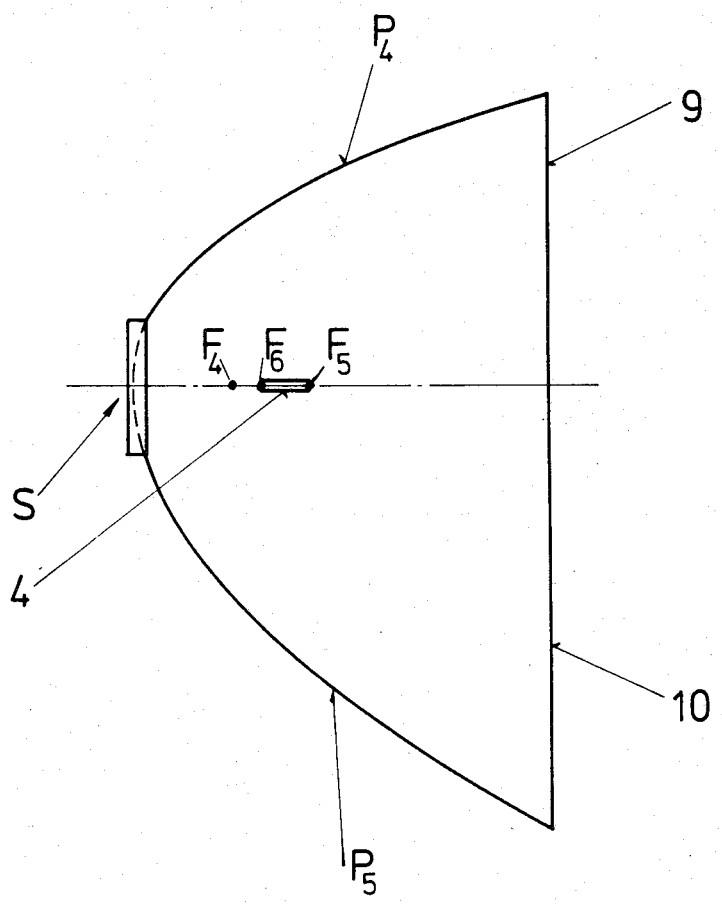
FIG. 6 is a vertical central view of the reflector of FIG. 5.

A reflector is shown in FIGS. 5 to 7 which is distinguished with respect to the reflector of FIGS. 1 to 3 in that the upper reflector part 9 is not a rotation parabola. The lower reflector part 10 is formed just like the lower reflector part 2 in FIG. 2. The lower reflector section shows the reflector illustrated in FIG. 5 in the upper as a parabola branch $P_4$ with the focal point $F_4$. The lower reflector part 10 shows in the vertical section a parabola branch $P_5$ with a focal point $F_5$. The focal length increases continuously in the middle sections through the upper reflector part 9, which is placed sideways from the vertical middle section up to the horizontal middle section through the upper part until the focal point $F_6$ is reached, which is at the same time the focal point of the parabola $P_6$, which results in case of a horizontal center section through the reflector. Here the focal point $F_6$ is placed in the end of the incandescent light filament 4 disposed toward the vertex. The upper reflector part thus no longer has a focal point but has a focal line which extends between the focal points $F_4$ and $F_6$. The lower reflector part 10 is provided in the vertical middle section with the parabola branch $P_5$ having the focal point $F_5$. The middle sections running on the side next to the vertical middle section through the lower reflector part 10 are provided with parabola branches, which have a smaller focal length. The focal length decreases continuously with the axis intersecting section planes approaching to the horizontal middle section. Thus there results a focal line for the lower reflector part which extends between the focal points $F_5$ and $F_6$.

Figure 8:
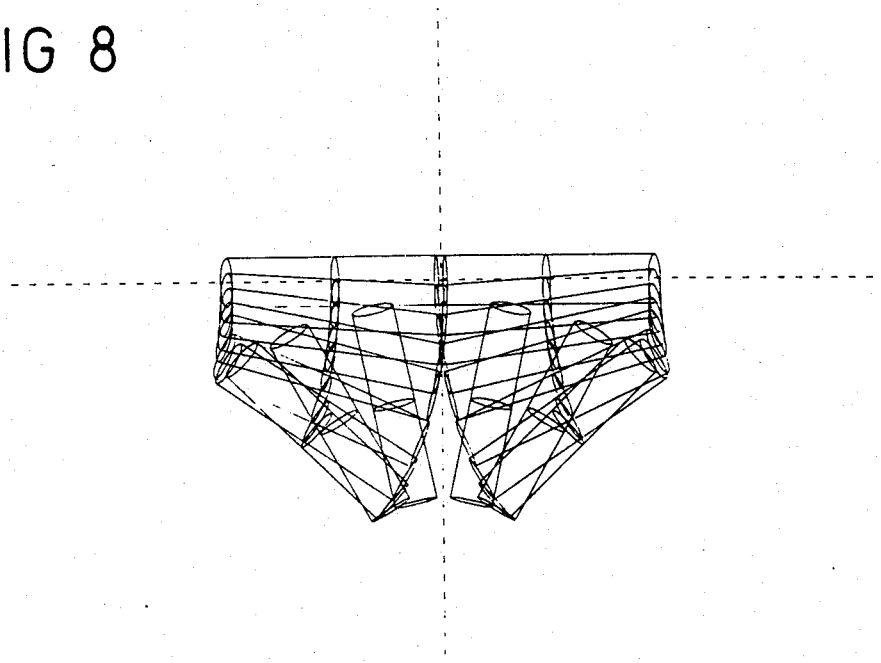
FIG. 8 is a view of the images of the light filament from the lower part of FIG. 5.
Figure 9:
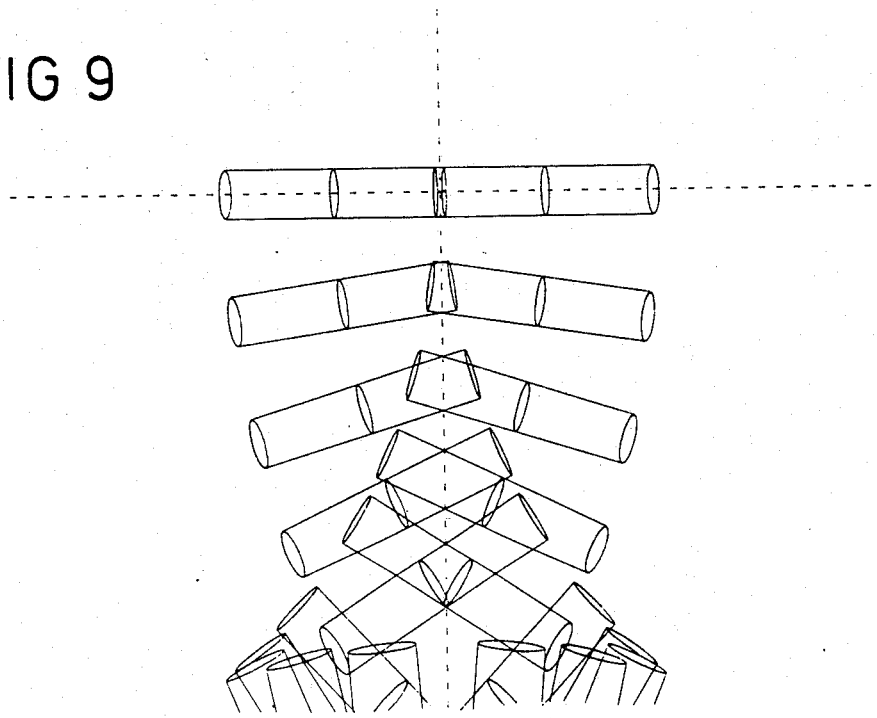
FIG. 9 is a schematic view of the images of the incandescent filament resulting from the upper part of the reflector according to FIG. 5.

The light distribution of the reflector according to FIGS. 5 to 7 is illustrated in FIGS. 8 and 9. FIG. 8 shows the filament images as they are generated in the lower relfector part 10. It becomes clear that the light from the lower reflector part experiences a concentration at the bright/dark boundary line. FIG. 9 illustrates picked images of the incandescent filament as they reflected by the upper reflector part 9. It becomes clear from this that the light from the upper reflector part 9 is drawn apart substantially in a vertical direction, and thus a illumination of the region immediately ahead of the headlight is achieved.

While the above embodiments substantially employ parabolic conical sections, the present invention is not limited to one hundred percent parabolic surface sections. It is possible to employ conical sections approaching a parabola. According to the preferred embodiment the sections run continuously, and preferably steps between adjacent parabola section are avoided. A reflector according to the present invention allows the concentration of the light beam in the area of the bright-/dark boundary line, and it further allows light to be thrown in an area immediately ahead of a headlight. In view of the employment of nearly parabolic sections, the light beam is well focussed for providing sufficient light on remote objects.

It will be understood that each of the elements described above, or two or more together, may also find a useful application in other types of dimmed vehicle headlight configurations and procedures differing from the types described above.

While the invention has been illustrated and described as embodied in the context of a dimmed vehicle headlight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A dimmed vehicle headlight comprising a light source extending in the direction of a light beam to be emitted; and a concave reflector surrounding the light source where planar sections through the reflector surface approximate sections of cones which have the same vertex point disposed in the opposite direction of the beam direction relative to the light source such that the vertex point forms the center of a Cartesian coordinate system and where the spacing of the close point of the light source relative to the vertex point is designated af $f_1$ and where the distance of the remote point of the light source relative to the vertex is designated as $f_2$ and where a y-axis is disposed at the connection line from the vertex to the light source and where the cone section shaped surfaces are in a coordinate system where an x-axis runs through the vertex point in a plane containing the respective cone section and where the cone sections approximate the following equation $$y^2(A)=2p(A)x+kp(A)x^2$$

where A is the absolute value of the intersection angle of the respective cone section plane with a horizxontal plane, where p(A) is between about $0.95f_1$ and $1.05f_1$ for cone sections disposed in a horizontal plane containing the vertex point, where p(A) is between from about $2f_1-f_2$ to $f_1$ for the cone section disposed above said horizontal plane and disposed in a vertical plane, where p(A) is a continuous decreasing function of the angle A for cone sections disposed above said horizontal plane, where p(A) is about equal $f_2$ for the cone section disposed belowsaid horizontal plane and disposed in a vertical plane, with the proviso that at least for an intersection angle of cone section plane and horizontal plane of about 31 degrees the value p(A) starts to be different from P(O), and where k can have a value from about—0.02 to 0.02.

2. The dimmed vehicle headlight according to claim 1 wherein the absolute value of k is less than about 0.005.

3. The dimmed vehicle headlight according to claim 1 wherein the absolute value of k is about zero.

4. The dimmed vehicle headlight according to claim 1 wherein the function p(A) is an about linear function of the angle A: $p(A)=f_1+A/90(f_2-f_1)$ for cone sections disposed below said horizontal plane containing the vertex of the cone sections.

5. The dimmed vehicle headlight according to claim 1 wherein the function p(A) is an about sinusoidal function of the angle A: $p(A)=f_1+\sin(A)(f_2-f_1)$ for cone sections disposed below said horizontal plane containing the vertex of the cone sections.

6. The dimmed vehicle headlight according to claim 1 wherein the function p(A) is an about square function of the angle A: $p(A)=f_1+A^2/8100)(f_2-f_1)$ for cone sections disposed below said horizontal plane containing the vertex of the cone sections.

7. The dimmed vehicle headlight according to claim 1 wherein the function p(A) is an about linear function of the angle A: $p(A)=f_1+uA/90(f_1-f_2)$ for cone sections disposed above said horizontal plane containing the vertex of the cone sections and where the parameter u is a parameter having a value of from about 0 to 1.

8. The dimmed vehicle headlight according to claim 1 wherein the function p(A) is: $p(A)=f_1+u(f_1-f_2)$ for the cone section disposed above said horizontal plane containing the vertex of the cone sections and disposed in the vertical plane and where the parameter u can have a value of from about 0 to 0.5.

9. The dimmed vehicle headlight according to claim 8 wherein the function p(A) assumes the value: p(90 degrees upward)$=f_1$ for the cone section disposed above said horizontal plane containing the vertex of the cone sections and disposed in the vertical plane and where the parameter u can have a value of from about 0 to 1.

10. The dimmed vehicle headlight according to claim 1 where p(A) is about $f_1$ for cone sections disposed in a horizontal plane containing the vertex point, 11. The dimmed vehicle headlight according to claim 1 wherein the upper part of the reflector extends by at most 30 degrees downward beyond the horizontal middle plane on the side of the reflector disposed to the side of the oncoming traffic.

12. A dimmed vehicle headlight comprising a concave reflector having an optical axis;

an electric filament extending longitudinally in the direction of the optical axis;

where a horizontal section of the reflector is represented by a parabola, the focal point of which coincides with a focal point of an upper reflector part;

where a part of the reflector disposed below its horizontal plane is a parabola branch and is provided with a focal point more remote from a vertex point, and all sections in a lower reflector part containing the optical axis are branches of a respective parabola, where the focal length of the parabola branches continuously decreases from a vertical section to the horizontal section;

where a part of the reflector disposed above its horizontal plane is a parabola branch and is provided with a focal point close to a vertex point; and where the focal points of the parabola branches are disposed on the optical axis and where the loci of the focal points of the various parabola branches include the extension of the filament; and where the parabolas of the upper reflector part continuously join the parabolas of the lower reflector part.

13. The dimmed vehicle headlight according to claim 12 where the transition from the upper reflector section formed as part of a rotation parabola to the lower reflector part associated with a line of focal points is disposed in an optical axis intersecting plane located below the horizontal middle plane on the side of the reflector disposed relatively close to the center of the road and where the angle between the plane intersecting the optical axis and the middle plane is about 15 degrees.

14. The dimmed vehicle headlight according to claim 12 where the focal point of the upper reflector section is represented by a focal line, which starts at the focal point of the parabola associated with the horizontal middle section of the reflector and which extends toward the vertex of the reflector.

15. A method for producing a dimmed beam at a vehicle headlight comprising forming a concave reflector having an internal reflection surface where planar sections through the reflector surface approximate sections of cones which have the same vertex point disposed in the opposite direction of the beam direction relative to the light source such that the vertex point forms the center of a Cartesian coordinate system and where the spacing of the close point of the light source relative to the vertex point is designated as $f_1$ and where the distance of the remote point of the light source relative to the vertex is designated as $f_2$ and where a y-axis is disposed at the connection line from the vertex to the light source and where the cone section shaped surfaces are in a coordinate system where an x-axis runs through the vertex point in a plane containing the respective cone section and where the cone sections approximate the following equation $$y^2(A)=2p(A)x+kp(A)x^2$$

where A is the absolute value of the intersection angle of the respective cone section plane with a horizontal plane, where p(A) is between about $0.95f_1$ and $1.05f_1$ for cone sections disposed in a horizontal plane containing the vertex point, where p(A) is between from about $2f_1-f_2$ to $f_1$ for the cone section disposed above said horizontal plane and disposed in a vertical plane, where p(A) is a continuous decreasing function of the angle A for cone sections disposed above said horizontal plane, where p(A) is about equal $f_2$ for the cone section disposed below said horizontal plane and disposed in a vertical plane, with the proviso that at least for an intersection angle of cone section plane and horizontal plane of about 31 degrees the value p(A) starts to be different from P(O), and where k cn have a value from about—0.02 to 0.02; and placing a light source in the reflector with the longitudinal extension of the light source at least in part coinciding with a line of focal points of cone section branches formed by intersecting the reflector surface with respective planes each including the axis of the reflector.

16. The method for producing a dimmed beam at a vehicle headlight according to claim 15 wherein the absolute value of k is less than about 0.005.

17. The method for producing a dimmed beam at a vehicle headlight according to claim 15 wherein the absolute value of k is about zero.

18. The method for producing a dimmed beam at a vehicle headlight according to claim 15 wherein the function p(A) is an about linear function of the angle A: $p(A)=f_1+A/90(f_2-f_1)$ for cone sections disposed below said horizontal plane containing the vertex of the cone sections.

19. The method for producing a dimmed beam at a vehicle headlight according to claim 15 wherein the function p(A) is an about linear function of the angle A: $p(A)=f_1+uA/90(f_1-f_2)$ for cone sections disposed above said horizontal plane containing the vertex of the cone sections and where the parameter u is a parameter having a value of from about 0 to 1.

20. The method for producing a dimmed beam at a vehicla headlight according to claim 15 wherein the function p(A) is: $p(A)=f_1+u(f_1-f_2)$ for the cone section disposed above said horizontal plane containing the vertex of the cone sections and disposed in the vertical plane and where the parameter u can have a value of from about 0 to 0.5.

21. The method for producing a dimmed beam at a vehicle headlight according to claim 20 wherein the function f(A) assumes the value: p(90 degrees upward)$=f_1$ for the cone section disposed above said horizontal plane containing the vertex of the cone sections and disposed in the vertical plane and where the parameter u can have a value of from about 0 to 1.

* * * * *